US012378708B2

(12) United States Patent
Yu

(10) Patent No.: US 12,378,708 B2
(45) Date of Patent: Aug. 5, 2025

(54) CIRCULAR KNITTING MACHINE FOR KNITTING PILE FABRIC

(71) Applicant: PAI LUNG MACHINERY MILL CO., LTD., New Taipei (TW)

(72) Inventor: Jen-Wei Yu, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 0 days.

(21) Appl. No.: 18/352,567

(22) Filed: Jul. 14, 2023

(65) Prior Publication Data

US 2025/0019873 A1 Jan. 16, 2025

(51) Int. Cl.
*D04B 9/12* (2006.01)
*D04B 35/02* (2006.01)
*D04B 35/34* (2006.01)

(52) U.S. Cl.
CPC ..... *D04B 9/12* (2013.01); *D04B 35/02* (2013.01); *D04B 35/34* (2013.01)

(58) Field of Classification Search
CPC . D04B 9/06; D04B 9/065; D04B 9/12; D04B 15/322; D04B 35/02; D04B 35/34
USPC ..... 66/19, 20, 27, 91, 92
See application file for complete search history.

(56) References Cited

U.S. PATENT DOCUMENTS 3,477,255 A * 11/1969 Lombardi ..... D04B 9/26 66/91
4,026,126 A * 5/1977 Nuber ..... D04B 9/12 66/194
4,127,013 A * 11/1978 Nuber ..... D04B 9/12 66/121
4,592,212 A * 6/1986 Schmidt ..... D04B 9/12 66/91
5,463,882 A * 11/1995 Yeh ..... D04B 9/12 66/90
5,862,681 A * 1/1999 Schmidt ..... D04B 9/12 66/106
6,094,944 A * 8/2000 Schmidt ..... D04B 23/08 66/93
7,127,920 B1 * 10/2006 Su ..... D04B 9/12 66/92
9,890,486 B2 2/2018 Yu

FOREIGN PATENT DOCUMENTS

GB 988865 A 4/1965

* cited by examiner

*Primary Examiner* — Aiying Zhao
(74) *Attorney, Agent, or Firm* — MUNCY, GEISSLER, OLDS & LOWE, P.C.

(57) ABSTRACT

A circular knitting machine for knitting a pile fabric with short stitch length, the circular knitting machine includes a needle dial, a needle bed, a gap formed by the needle dial and the needle bed, knitting needles on the needle dial, crochet needles on the needle bed, a cutter holder, and cutters on the cutter holder and facing the gap. Movement tracks of the crochet needles are crisscrossed with movement tracks of the knitting needles and movement tracks of the cutters. Each of the crochet needles has a butt portion, a hook portion, and a protruding shoulder portion between the butt portion and the hook portion, the protruding shoulder portion forms an eyelet, and the protruding shoulder portion is configured to be capable of expanding a yarn loop on the crochet needles to facilitate the cutters to cut the yarn loop at the eyelet to form a pile.

6 Claims, 12 Drawing Sheets

CIRCULAR KNITTING MACHINE FOR KNITTING PILE FABRIC

FIELD OF THE INVENTION

The invention relates to a circular knitting machine, and more particularly to a circular knitting machine capable of realizing a pile fabric with short stitch length by crochet needles with protruding shoulder portions and eyelets.

BACKGROUND OF THE INVENTION

Although GB988865A and U.S. Pat. No. 9,890,486 respectively disclose the technical solutions that the circular knitting machine is capable of directly forming piles during a knitting process, the aforementioned two patents need to be implemented by disposing a plurality of hooking needles and a plurality of cutters side by side at intervals, resulting in reduction in a number of stitches that can be performed within one inch by the circular knitting machine, and therefore the circular knitting machine is incapable of knitting fabrics with short stitch length.

U.S. Pat. No. 4,592,212 discloses another technical solution which realizes shearing by the circular knitting machine through the pile element (indicated as 1) and the shearing element (indicated as 2) of special structures. In one embodiment, the pile element is composed of two parts, a space for the shearing element to insert into is formed between the two parts, and one of the two parts is formed with a knife edge to cooperate with the shearing element. During implementation, the shearing element swings toward the pile element, and cooperates with the knife edge when inserting into the space to generate shearing to cut off the yarn loop. One of the two parts of the pile element is elastic to produce deformation when the shearing element is inserting into the space. In this way, control of the circular knitting machine needs to be very accurate, otherwise it is easy for the pile element to collide with the shearing element by mistake, which is very unfavorable for the high-speed knitting of the existing circular knitting machines. In addition, in U.S. Pat. No. 4,592,212, the tension state of the yarn loop is not changed during the shearing process, and the yarn is soft, so the problem of shearing failure is prone to occur.

SUMMARY OF THE INVENTION

A main object of the invention is to solve the problem with stitch length caused by the conventional circular knitting machines required to be implemented with hooking needles and cutters.

Another main object of the invention is to solve the problem that the conventional structures are not applicable to the existing circular knitting machines.

In order to achieve the above objects, the invention provides a circular knitting machine for knitting a pile fabric with short stitch length, the circular knitting machine has a needle dial, a needle bed, a gap defined and formed by the needle dial and the needle bed, a plurality of knitting needles disposed on the needle dial, a plurality of crochet needles disposed on the needle bed, a cutter holder, and a plurality of cutters disposed on the cutter holder and facing the gap. A movement track of each of the crochet needles is crisscrossed with a movement track of one of the knitting needles, and a movement track of each of the cutters is crisscrossed with the movement track of one of the crochet needles. Each of the crochet needles has a butt portion, a hook portion, and a protruding shoulder portion between the butt portion and the hook portion, the protruding shoulder portion forms an eyelet, and each of the protruding shoulder portions of the plurality of crochet needles is configured to be capable of expanding a yarn loop on one of the plurality of crochet needles to facilitate one of the plurality of cutters to cut the yarn loop at the eyelet to form a pile.

In one embodiment, each of the crochet needles is formed by assembling two needle plates with each other, each of the two needle plates has a bent section for forming the eyelet, each of the two needle plates has a boss on the bent section, and an inclined plane connected with the boss and extending toward the hook portion.

In one embodiment, the inclined plane has a turning convex point, and slopes of the inclined plane on two sides of the turning convex point are different.

In one embodiment, in each of the plurality of crochet needles, an opening of the hook portion is located on a same side of the boss.

In one embodiment, the circular knitting machine has a plurality of crochet needle actuators provided for determining the movement tracks of the crochet needles, a plurality of crochet needle cams provided for guiding the crochet needles, and a plurality of cutter cams provided for guiding the cutters.

Through the aforementioned implementation of the invention, the invention has the following characteristics compared with the prior art:

1. the circular knitting machine of the invention does not need to be implemented by disposing a plurality of hooking needles and a plurality of cutters side by side at intervals, but is capable of performing more stitches within a same distance to achieve short stitch length;
2. the invention abandons the technical means of forming the pile by shearing with two blades in the past, the yarn loop used to form the pile is expanded by the protruding shoulder portion of one of the crochet needles before being cut off by one of the cutters to change a tension, so that one of the cutters is capable of cutting off the yarn loop more smoothly to form the pile; and
3. the eyelet on each of the crochet needles of the invention is capable of making the cutters have appropriate control errors.

DETAILED DESCRIPTION OF THE PREFERRED EMBODIMENTS

The detailed description and technical content of the invention are described below with reference to the accompanying drawings.

Figure 1:
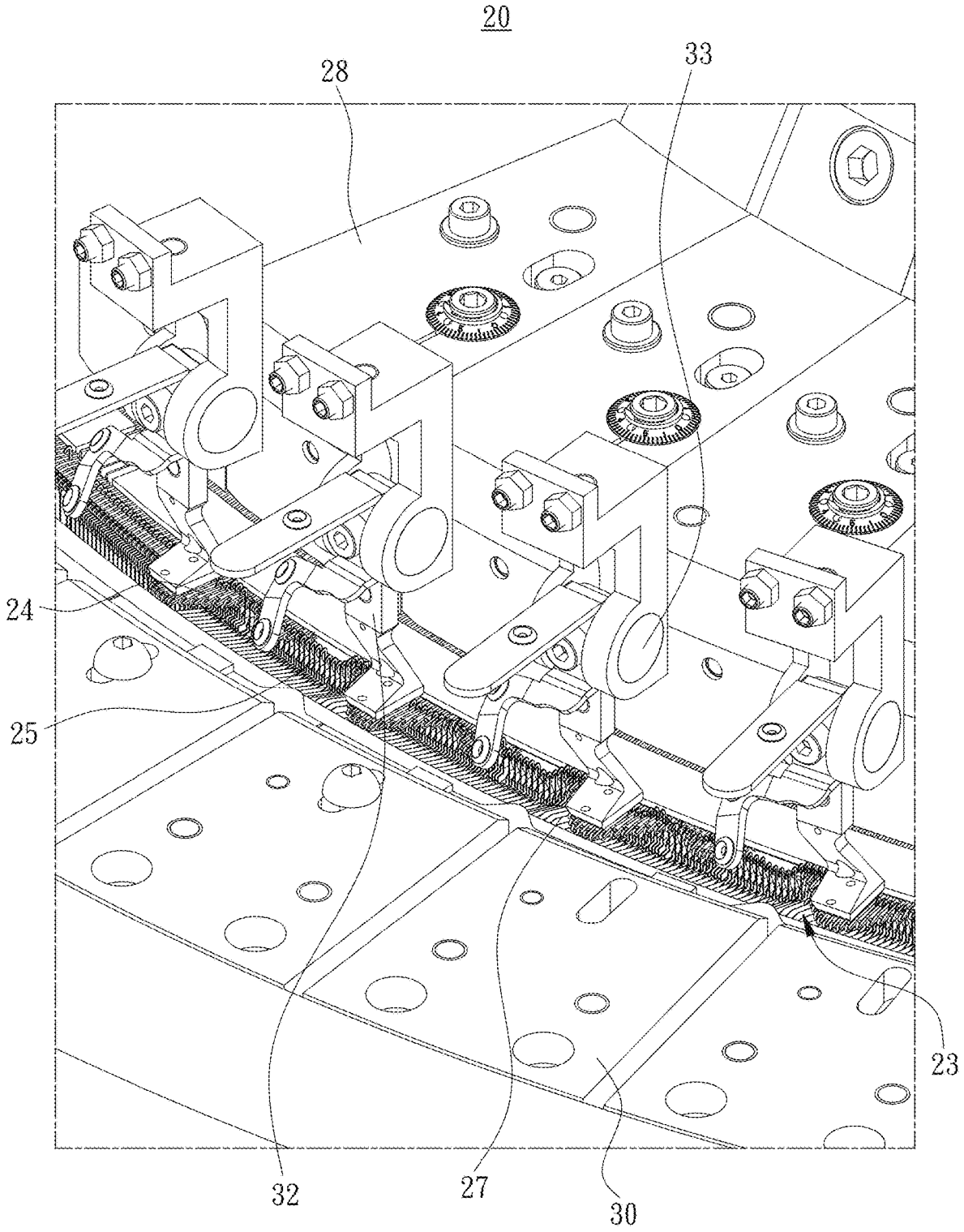
FIG. 1 is a perspective view of partial structures of a circular knitting machine of the invention.
Figure 2:
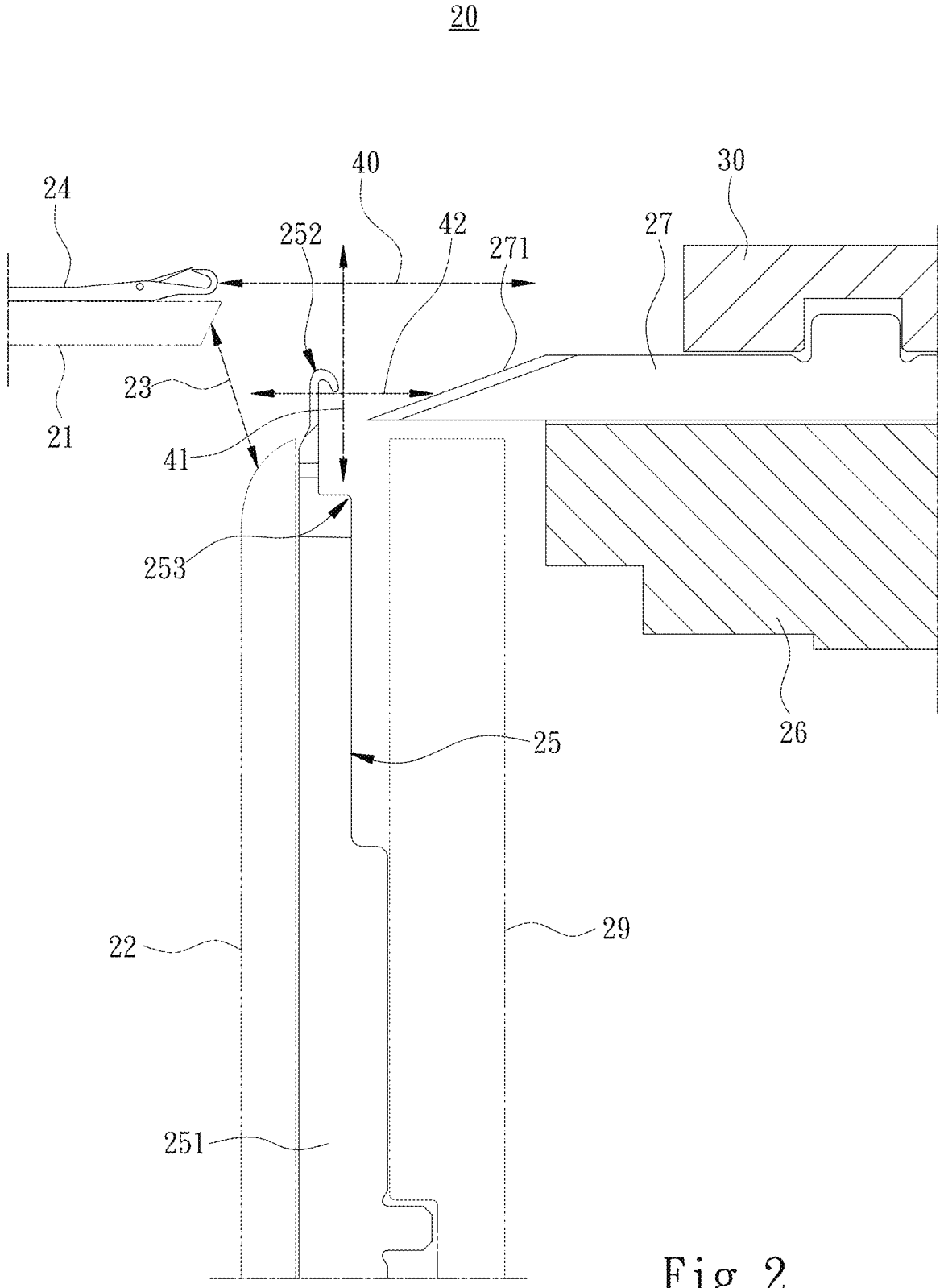
FIG. 2 is a schematic diagram of partial structures of the circular knitting machine of the invention.
Figure 3:
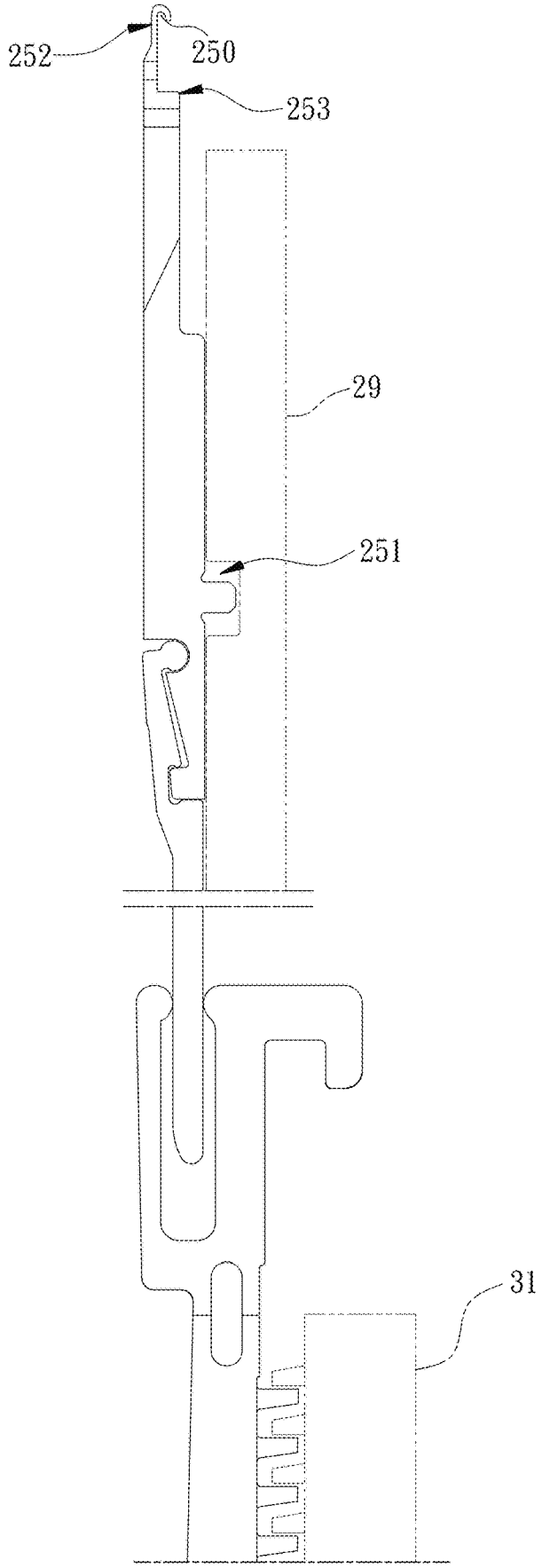
FIG. 3 is a schematic structural diagram of a crochet needle of the invention.
Figure 4:
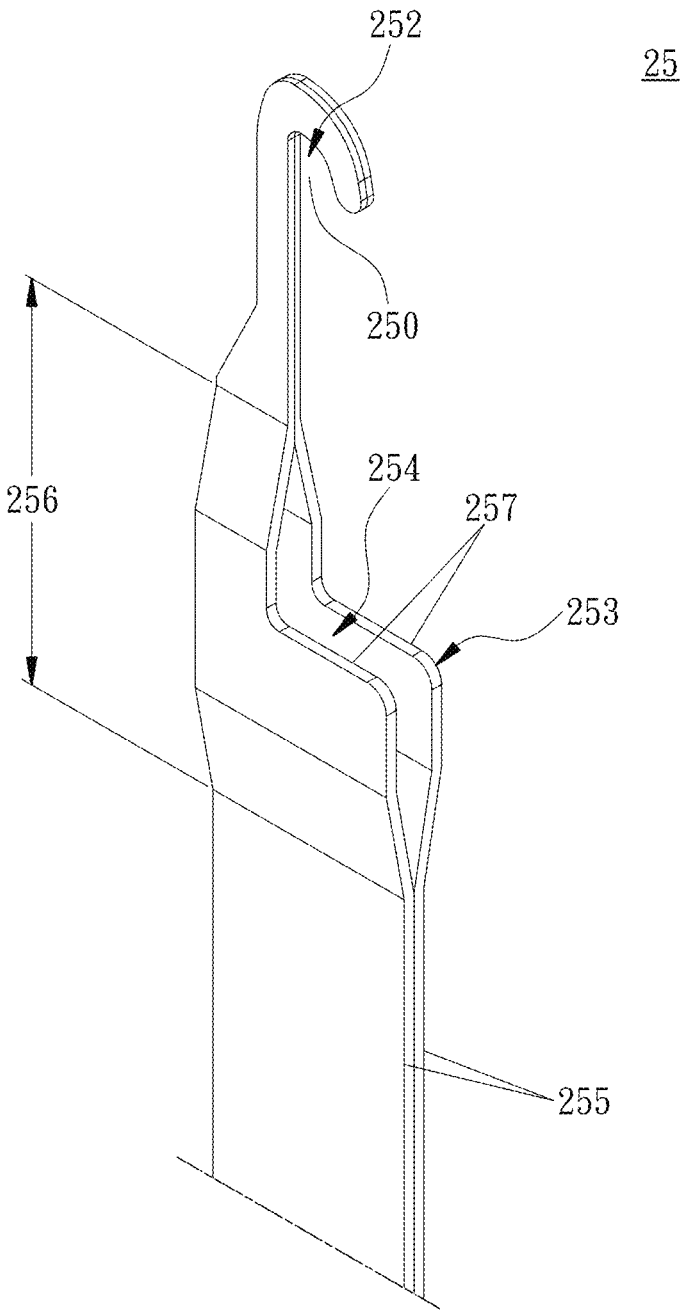
FIG. 4 is a perspective view of partial structures of the crochet needle of the invention.

Please refer to FIG. 1 and FIG. 2, the invention provides a circular knitting machine 20, and more particularly the circular knitting machine 20 capable of knitting a pile fabric with short stitch length. The circular knitting machine 20 includes a needle dial 21, a needle bed 22, a gap 23, a plurality of knitting needles 24, a plurality of crochet needles 25, a cutter holder 26, and a plurality of cutters 27. Wherein, the gap 23 is defined and formed by the needle dial 21 and the needle bed 22 jointly, and the gap 23 is a place where the circular knitting machine 20 performs knitting. The plurality of knitting needles 24 are disposed on the needle dial 21, the plurality of crochet needles 25 are disposed on the needle bed 22, and the plurality of cutters 27 are disposed on the cutter holder 26. In the invention, the plurality of knitting needles 24 are respectively implemented by a latch needle. Please refer to FIG. 3, FIG. 4 and FIG. 8, each of the plurality of crochet needles 25 includes a butt portion 251, a hook portion 252, and a protruding shoulder portion 253 between the butt portion 251 and the hook portion 252. The protruding shoulder portion 253 of each of the crochet needles 25 forms an eyelet 254, when each of the crochet needles 25 is viewed from a direction of penetrating the eyelet 254, each of the plurality of crochet needles 25 includes a wider part at the protruding shoulder portion 253. When each of the plurality of crochet needles 25 is inserted into a yarn loop 71 with the protruding shoulder portion 253, the yarn loop 71 will be expanded due to the protruding shoulder portion 253. Please refer to FIG. 3, FIG. 4 and FIG. 8. In one embodiment, each of the plurality of crochet needles 25 is formed by assembling two needle plates 255 with each other, each of the two needle plates 255 includes a bent section 256, and the eyelet 254 is formed by the two bent sections 256 after the two needle plates 255 are assembled with each other. Furthermore, a width of a plurality of needle grooves 221 of the needle bed 22 provided for accommodating the plurality of crochet needles 25 is consistent with a widest part of each of the plurality of crochet needles 25; that is to say, when each of the plurality of crochet needles 25 is accommodated in one of the needle grooves 221, the plurality of crochet needles 25 will not be deformed. Moreover, a cutting edge 271 of each of the plurality of cutters 27 faces the gap 23.

Please refer to FIG. 2, the plurality of knitting needles 24, the plurality of crochet needles 25 and the plurality of cutters 27 are respectively controlled to move in the gap 23, more specifically, the circular knitting machine 20 further includes a plurality of knitting needle cams 28, a plurality of crochet needle cams 29, and a plurality of cutter cams 30. Wherein, the plurality of knitting needle cams 28 are used to guide movements of the plurality of knitting needles 24, the plurality of crochet needle cams 29 are used to guide movements of the plurality of crochet needles 25, and the plurality of cutter cams 30 are used to guide movements of the plurality of cutters 27. Furthermore, a movement track of each of the plurality of knitting needles 24 (as indicated by 40 in FIG. 2) is crisscrossed with a movement track of one of the plurality of crochet needles 25 (as indicated by 41 in FIG. 2); and a movement track of each of the plurality of cutters 27 (as indicated by 42 in FIG. 2) is crisscrossed with the movement track of one of the plurality of crochet needles 25 (as indicated by 41 in FIG. 2).

Figure 5:
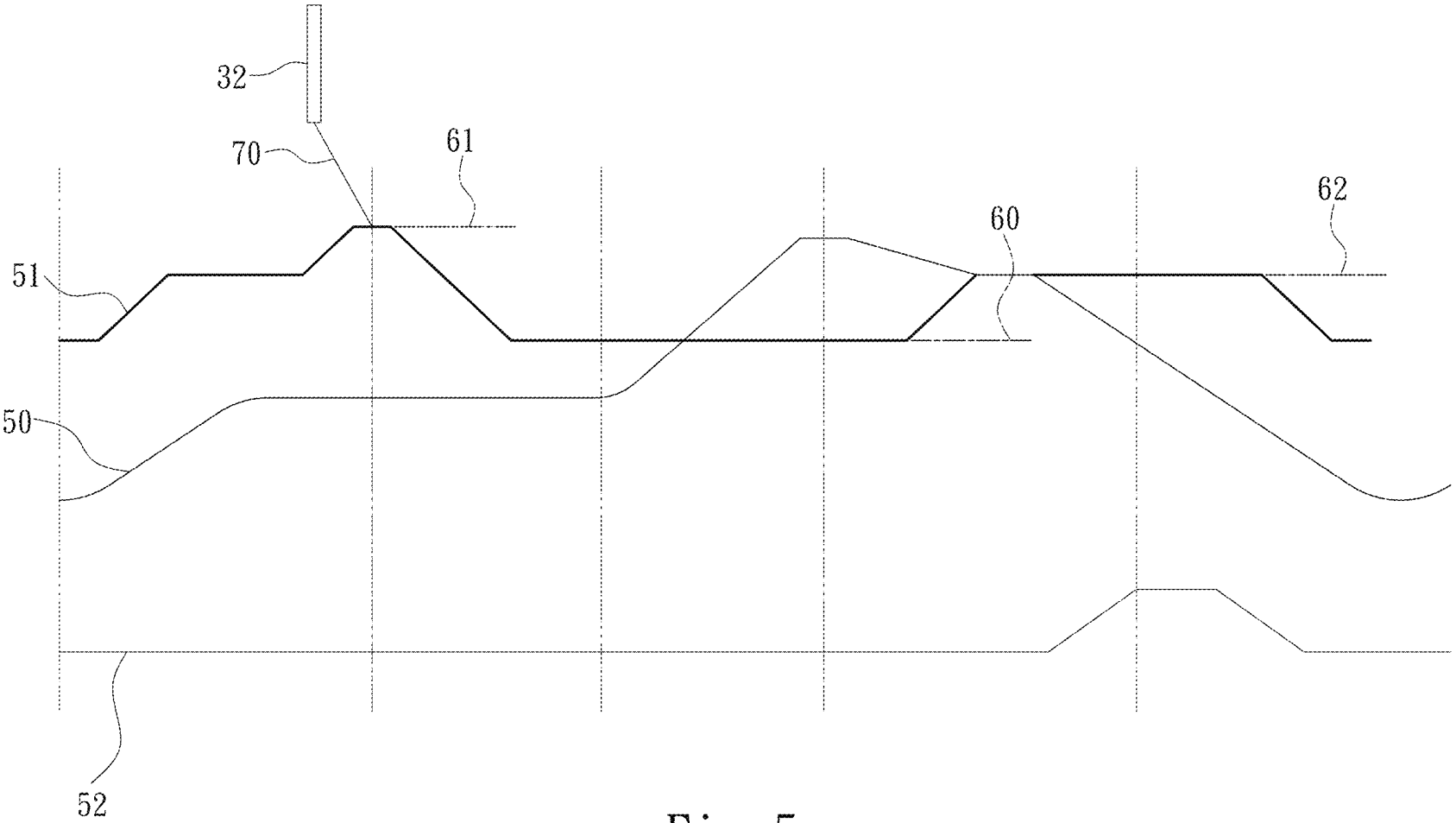
FIG. 5 is a first schematic diagram of movement tracks of a knitting needle, the crochet needle and a cutter of the invention.
Figure 8:
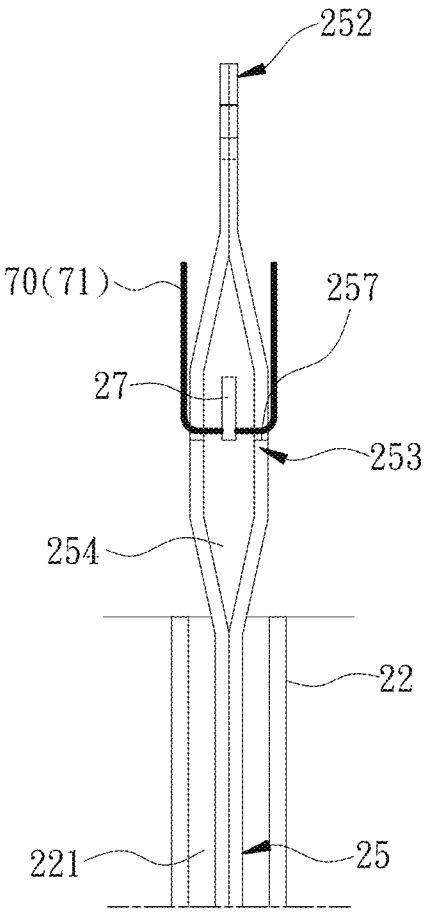
FIG. 8 is a third schematic diagram of action of the crochet needle of the invention.
Figure 7:
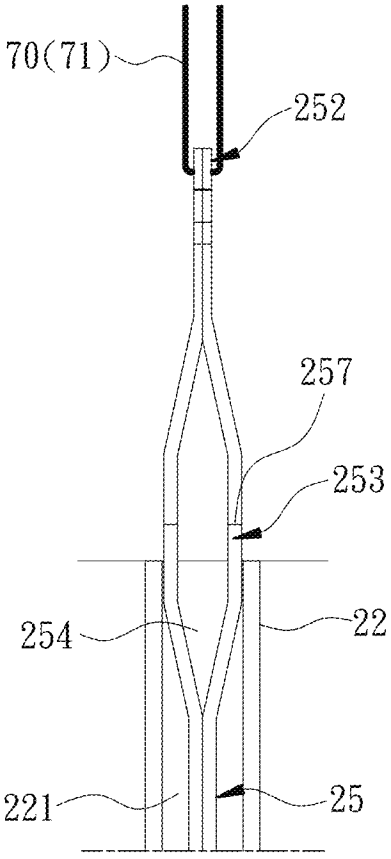
FIG. 7 is a second schematic diagram of action of the crochet needle of the invention.
Figure 6:
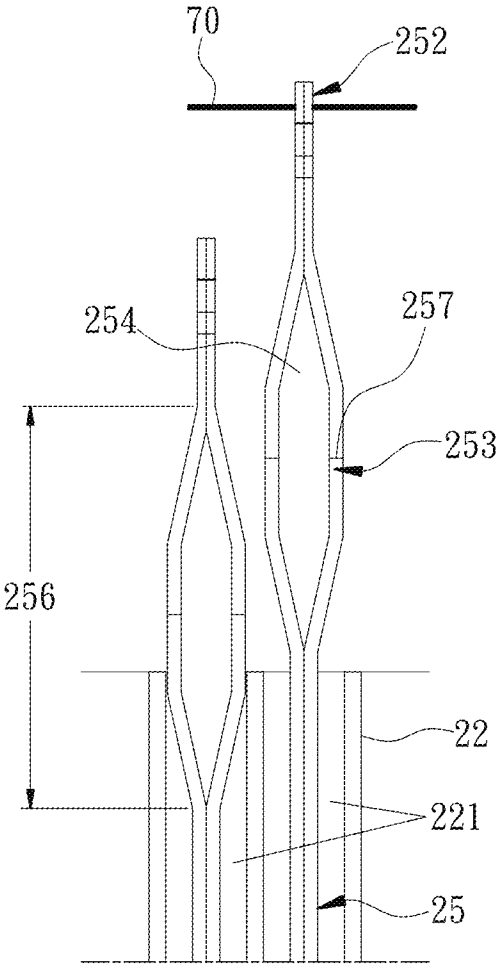
FIG. 6 is a first schematic diagram of action of the crochet needle of the invention.
Figure 9:
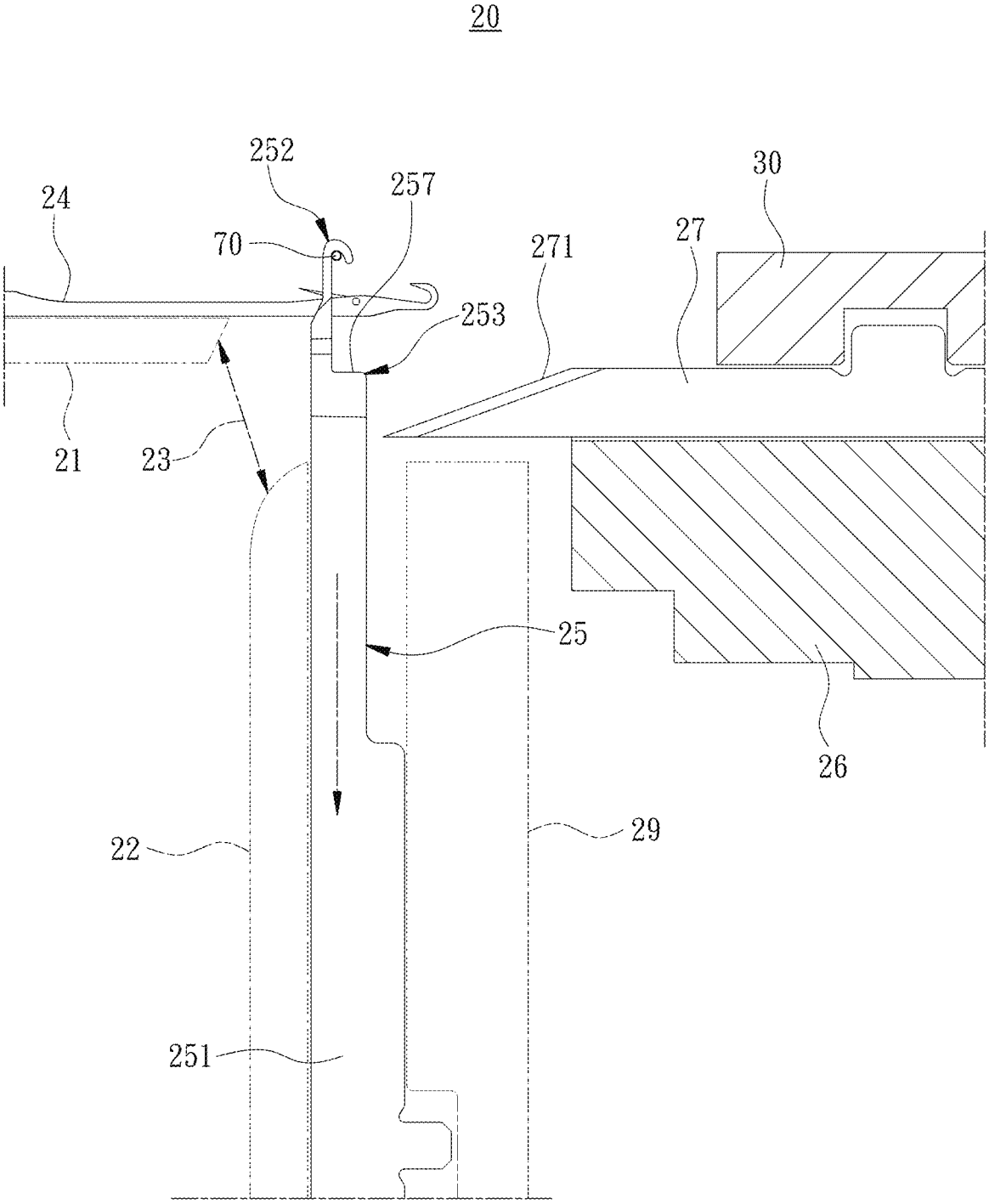
FIG. 9 is a first schematic diagram of action of the circular knitting machine of the invention.
Figure 10:
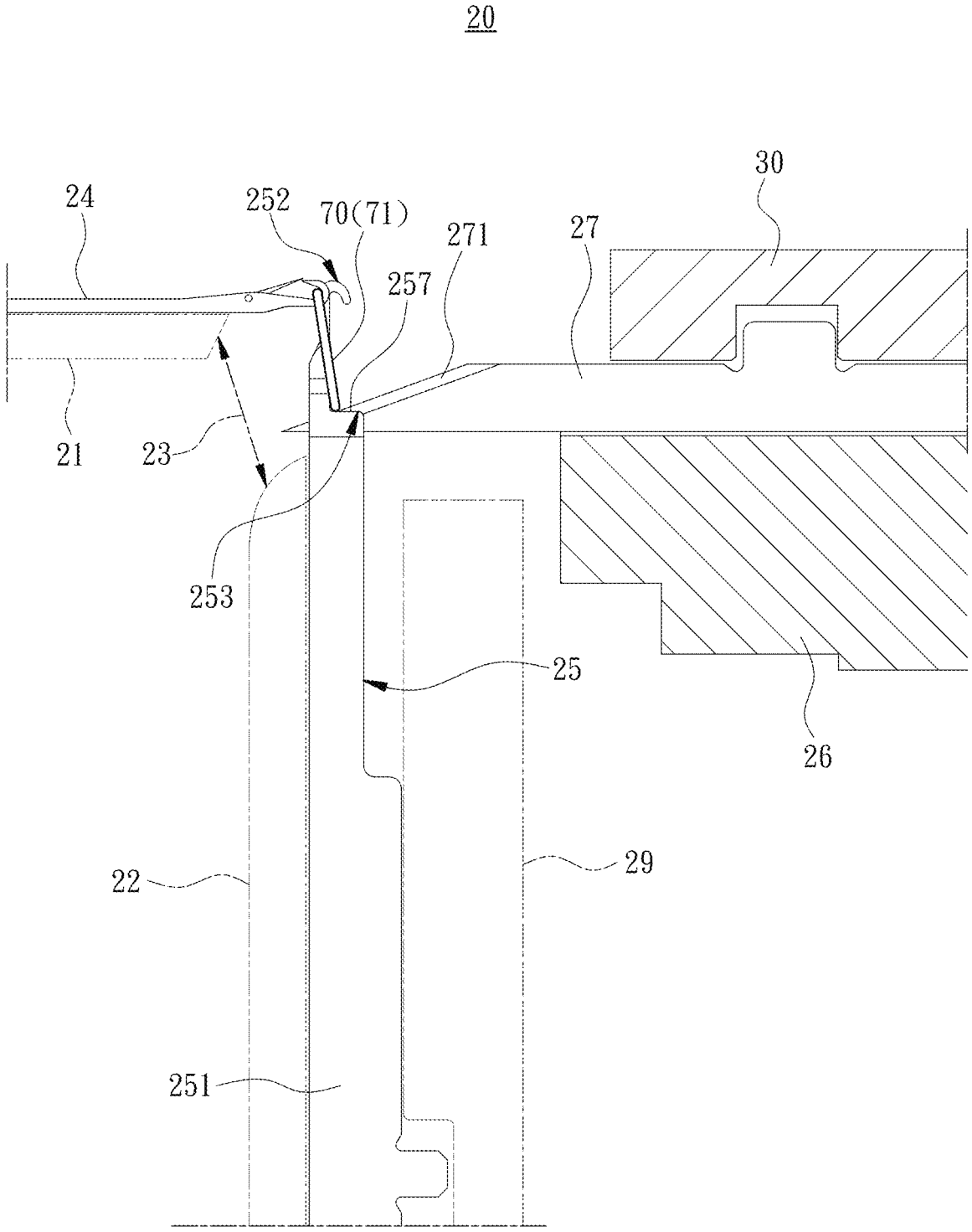
FIG. 10 is a second schematic diagram of action of the circular knitting machine of the invention.

Continue to explain knitting actions of the circular knitting machine 20 of the invention. Movement tracks of the plurality of knitting needles 24, the plurality of crochet needles 25 and the cutters 27 are shown in FIG. 5, wherein 50 indicated in FIG. 5 is a movement track of each of the plurality of knitting needles 24 guided by the plurality of knitting needle cams 28; and 51 indicated in FIG. 5 is a movement track of each of the plurality of crochet needles 25 guided by the plurality of crochet needle cams 29; and 52 indicated in FIG. 5 is a movement track of each of the plurality of cutters 27 guided by the plurality of cutter cams 30. Each of the plurality of knitting needles 24 is mainly used for knitting to form a basic structure of the pile fabric, that is to say, each of the plurality of knitting needles 24 keeps hooking and forming loops from yarn during a knitting process. Please refer to FIG. 5 again, the invention forms piles mainly by the plurality of crochet needles 25 and the plurality of cutters 27, each of the plurality of crochet needles 25 mainly moves in three positions, one position is a narrowing position (as indicated by 60 in FIG. 5), second position is a yarn hooking position (as indicated by 61 in FIG. 5), and third position is a yarn cutting position (as indicated by 62 in FIG. 5). Observing heights of the narrowing position 60, the yarn hooking position 61 and the yarn cutting position 62 in the gap 23, the yarn hooking position 61 is the highest, followed by the yarn cutting position 62, and the narrowing position 60 is the lowest. When one of the plurality of crochet needles 25 moves from the narrowing position 60 to the yarn hooking position 61, the hook portion 252 is provided for hooking a yarn 70 fed by a yarn feeder 32, as shown in FIG. 6 and FIG. 9. Thereafter, one of the plurality of crochet needles 25 is displaced towards the needle bed 22, as shown in FIG. 7. At this point, one of the plurality of crochet needles 25 hooks the yarn 70 to produce a segment that will be formed a pile. One of the plurality of crochet needles 25 is set to return to the narrowing position 60, but the invention is not limited thereto, as long as the hook portion 252 of one of the plurality of crochet needles 25 at this time is positioned below the yarn cutting position 62. Then, one of the plurality of crochet needles 25 hooked with the yarn 70 is guided by at least one of the plurality of crochet needle cams 29 again to advance toward the yarn cutting position 62. During this process, the yarn loop 71 formed by the yarn 70 is expanded by the protruding shoulder portion 253 of one of the plurality of crochet needles 25, and is slightly tight (that is, a tension of the yarn loop 71 changes), as shown in FIG. 8 and FIG. 10. At the time, the yarn loop 71 abuts against the protruding shoulder portion 253, one of the plurality of cutters 27 is guided to move towards one of the plurality of crochet needles 25, and the pile is formed by cutting the yarn loop 71 at the eyelet 254 of one of the plurality of crochet needles 25. It should be understood that during a process of one of the plurality of crochet needles 25 hooking the yarn 70, and the yarn 70 hooked is added into the basic structure by one of the plurality of knitting needles 24 for knitting, that is, the pile is connected to the basic structure.

Figure 12:
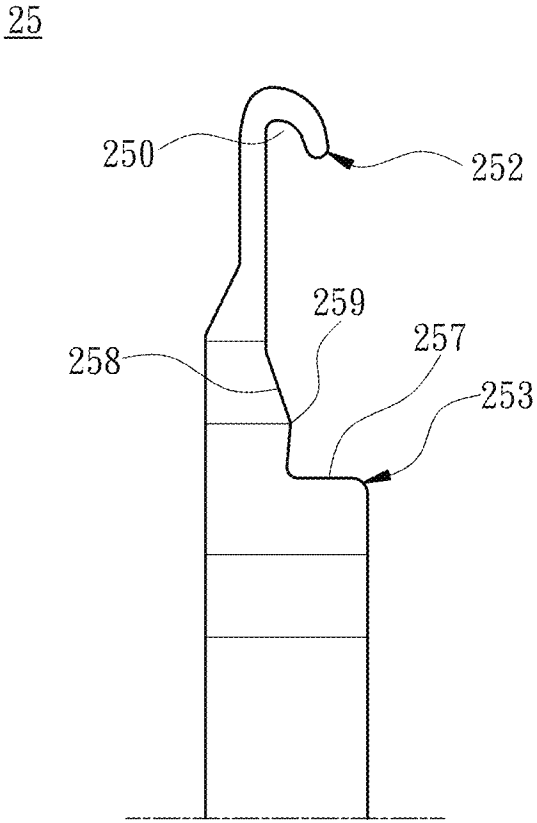
FIG. 12 is a second structural side view of the crochet needle of the invention.
Figure 11:
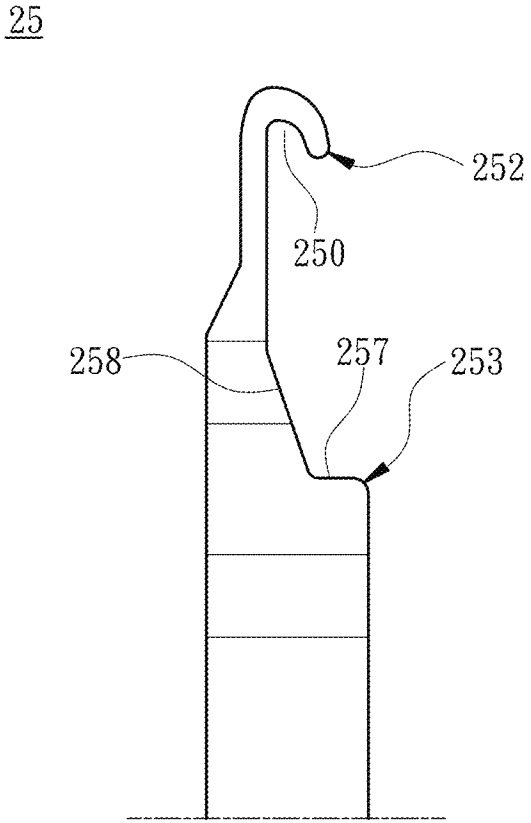
FIG. 11 is a first structural side view of the crochet needle of the invention.

Please refer to FIG. 11, in one embodiment, each of the two needle plates 255 provided for assembling and forming one of the plurality of crochet needles 25 includes a boss 257 on the bent section 256, and an inclined plane 258 connected with the boss 257 and extending toward the hook portion 252. In this embodiment, through the inclined plane 258, when one of the plurality of crochet needles 25 is displaced from the narrowing position 60 to the yarn cutting position 62 after hooking yarn (that is, when the yarn loop 71 is going to be expanded for cutting yarn), the yarn loop 71 on one of the plurality of crochet needles 25 is effectively expanded due to the inclined plane 258, which is conducive to yarn cutting by one of the plurality of cutters 27. Please refer to FIG. 12, in one embodiment, the inclined plane 258 is further provided with a turning convex point 259, that is, the inclined plane 258 is a non-straight surface, and the inclined plane 258 on two sides of the turning convex point 259 has different slopes. The turning convex point 259 makes the inclined plane 258 non-straight, when one of the plurality of crochet needles 25 is displaced from the narrowing position 60 to the yarn cutting position 62, the yarn loop 71 on one of the plurality of crochet needles 25 is restricted by the turning convex point 259, and displacement in error will not occur when one of the cutters 27 cuts yarn. On the other hand, in each of the plurality of crochet needles 25, an opening (as indicated by 250 in FIG. 4) of the hook portion 252 is located on a side as same as the boss 257.

The circular knitting machine 20 does not require disposal of hooking needles and cutters arranged side by side at intervals, such that more stitches are placed at equal distances (for example, one inch) to achieve short stitch length. The invention abandons technical means of forming the pile by shearing with two blades in the past, but adopts that the pile formed by the yarn loop 71 is expanded according to the protruding shoulder portion 253 of one of the plurality of crochet needles 25 before being cut off by one of the plurality of cutters 27 to change a tension so that one of the plurality of cutters 27 is capable of cutting off the yarn loop 71 more smoothly to form the pile. Furthermore, the eyelet 254 on each of the plurality of crochet needles 25 of the invention makes the plurality of cutters 27 can have appropriate control errors.

Figure 13:
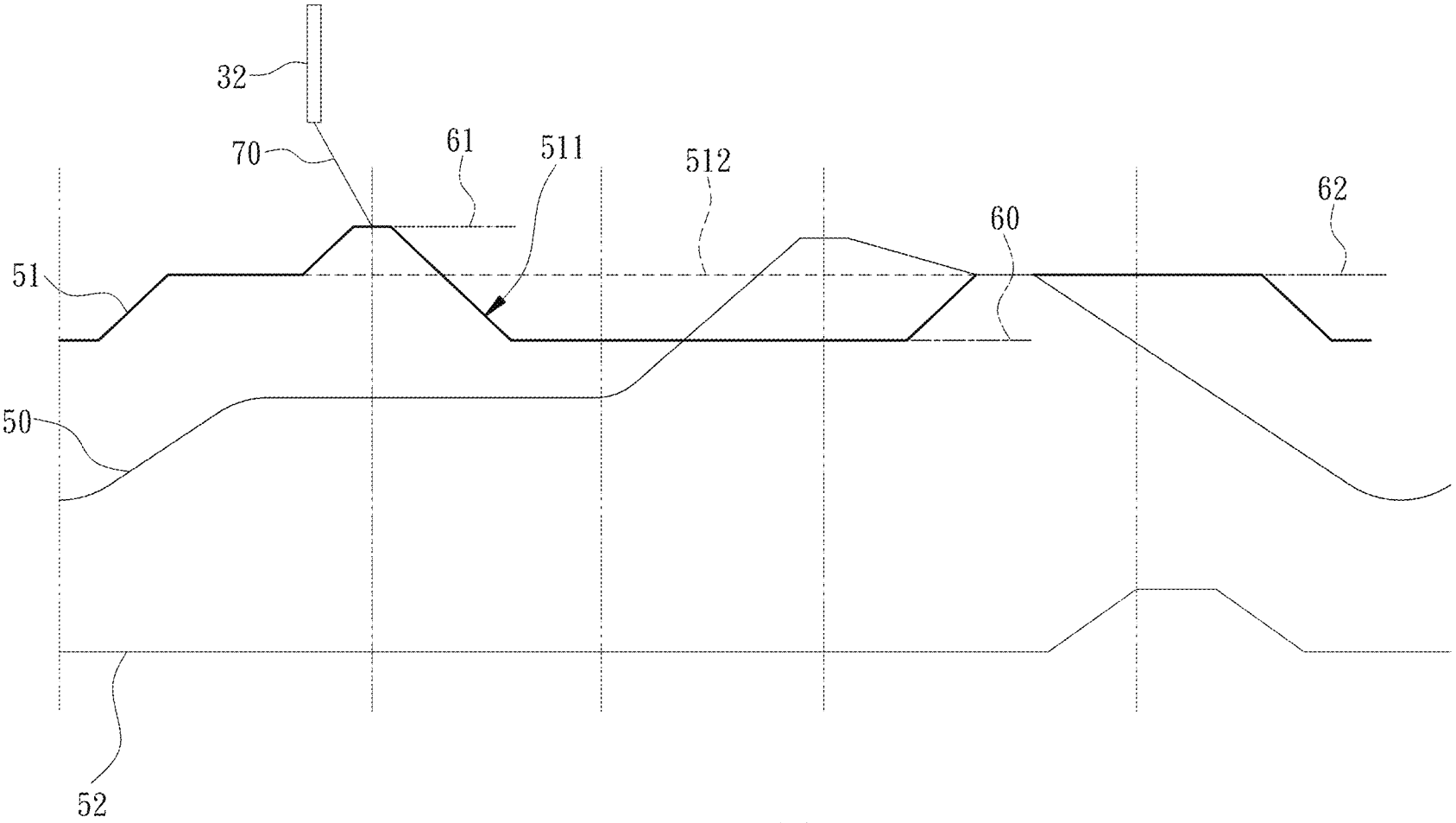
FIG. 13 is a second schematic diagram of the movement tracks of the knitting needle, the crochet needle and the cutter of the invention.
Figure 14:
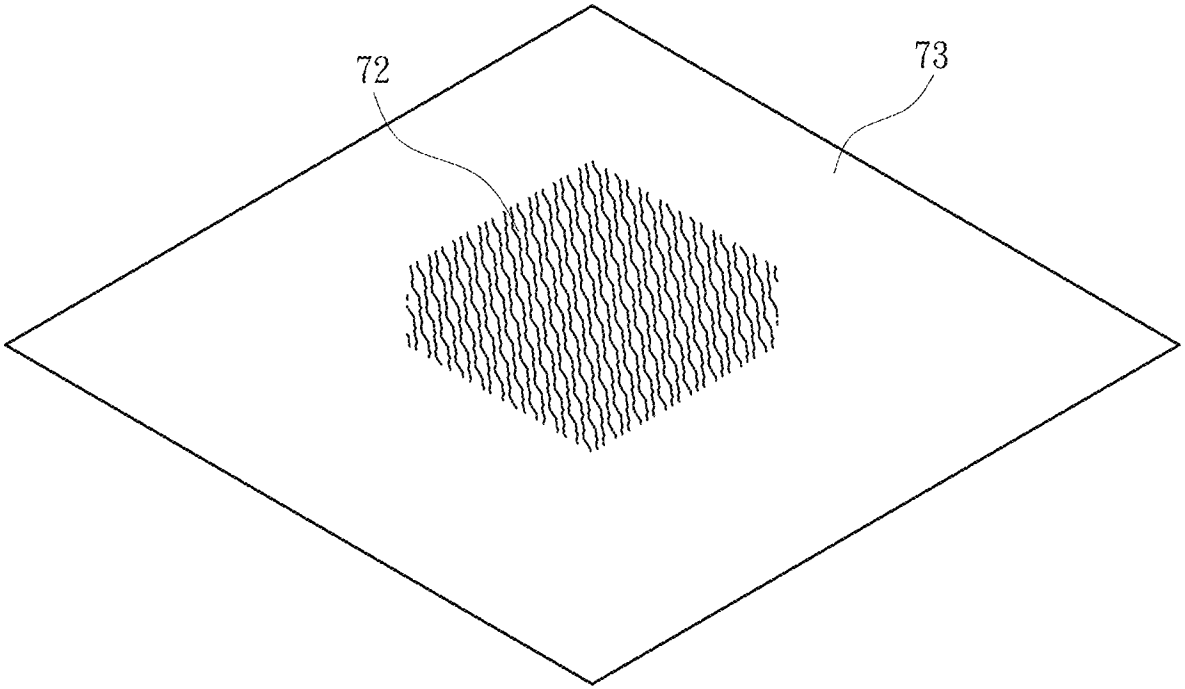
FIG. 14 is a schematic structural diagram of a pile fabric with short stitch length of the invention.

In addition to the foregoing, an implementation framework of the invention further overcomes limitations of the existing circular knitting machines when knitting the pile fabric, and the pile fabric is capable of directly forming piles locally during a knitting process. Please refer to FIG. 3 again, in one embodiment, the circular knitting machine 20 includes a plurality of crochet needle actuators 31, and each of the plurality of crochet needle actuators 31 is connected to the butt portion 251 of at least one crochet needle 25 to determine the movement track of one of the plurality of crochet needles 25. Please refer to FIG. 13, in this embodiment, the movement track 51 of each of the plurality of crochet needles 25 optionally includes one of the following: a yarn hooking stroke 511 and a non-hooking stroke 512. Each of the plurality of crochet needles 25 only moves with the yarn hooking stroke 511 or the non-hooking stroke 512 in each movement. When one of the plurality of crochet needles 25 moves with the yarn hooking stroke 511, actions will be sequentially produced as shown in FIG. 6, FIG. 7 and FIG. 8, and finally cooperates with one of the plurality of cutters 27 to form the pile. When one of the plurality of crochet needles 25 moves with the non-hooking stroke 512, one of the plurality of crochet needles 25 is not hooked with yarn, and the pile will not be produced. A knitted fabric is shown in FIG. 14, wherein 72 represents the pile, and 73 represents the basic structure. In this way, secondary processing procedures (such as singeing) can be omitted.

Figure 15:
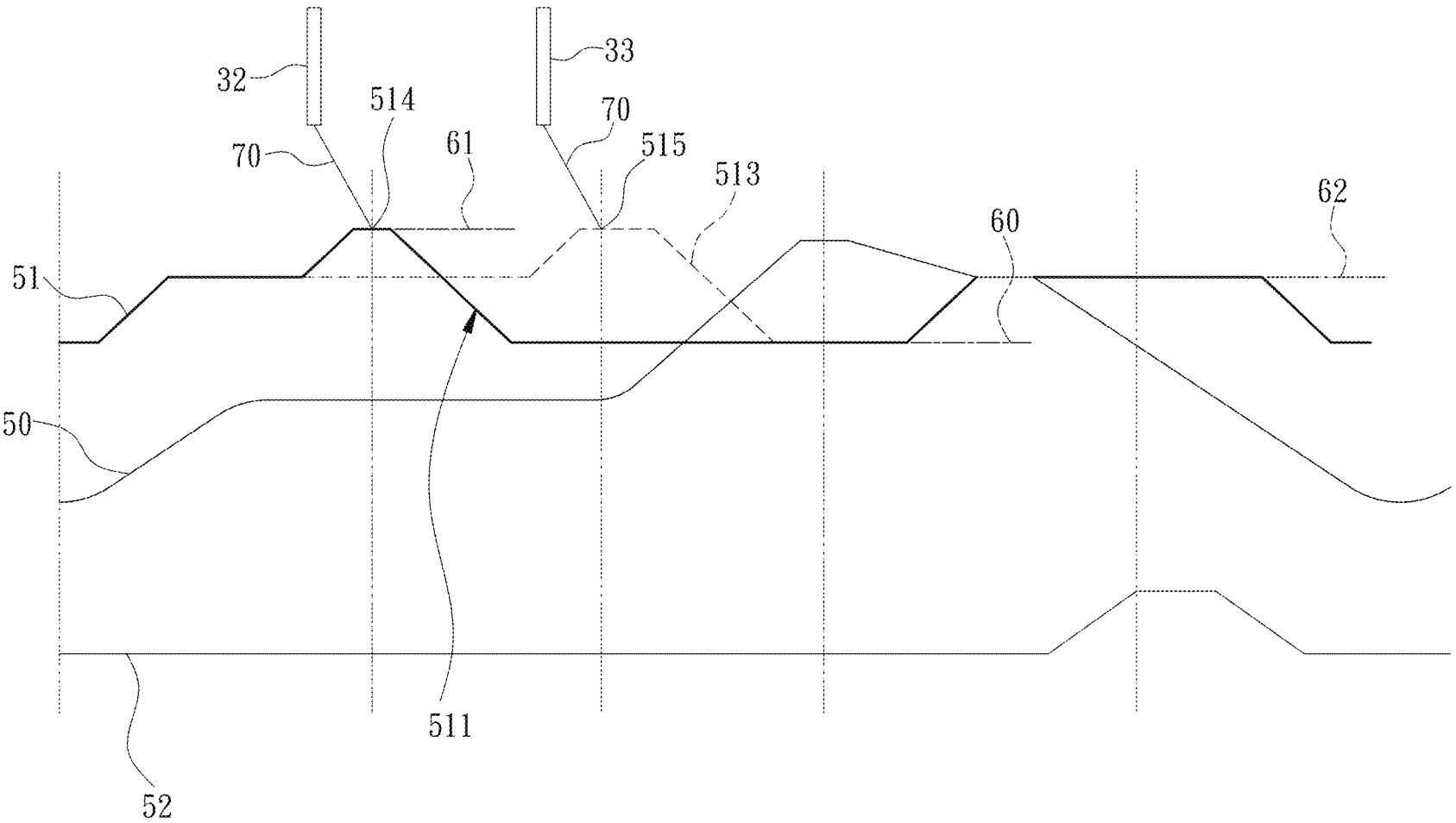
FIG. 15 is a third schematic diagram of the movement tracks of the knitting needle, the crochet needle and the cutter of the invention.

Please refer to FIG. 15. In one embodiment, the movement track 51 of each of the plurality of crochet needles 25 optionally includes the yarn hooking stroke 511 and a yarn hooking stroke 513, and either one of the yarn hooking stroke 511 or the yarn hooking stroke 513 is implemented. Two hooking points 514, 515 of the two yarn hooking strokes 511, 513 are different, and the two hooking points 514, 515 correspond to the yarn feeder 32 and a yarn feeder 33 respectively. Since yarns fed into the gap 23 by the two yarn feeders 32, 33 are of different colors, colors of the pile produced subsequently are different according to colors of the yarns hooked by the plurality of crochet needles 25. In this way, the circular knitting machine 20 of the invention achieves a technical solution of changing a color of the pile on the machine, and omits steps of performing secondary processing on the pile fabric. Furthermore, the embodiments disclosed in FIG. 13 and FIG. 15 of the invention can be implemented in combination.

What is claimed is:

1. A circular knitting machine for knitting a pile fabric, the circular knitting machine comprising a needle dial, a needle bed, a gap defined and formed by the needle dial and the needle bed, and a plurality of knitting needles disposed on the needle dial, characterized in that:

the circular knitting machine comprises a plurality of crochet needles disposed on the needle bed, a cutter holder, and a plurality of cutters disposed on the cutter holder and facing the gap, a movement track of each of the plurality of crochet needles is crisscrossed with a movement track of one of the plurality of knitting needles, a movement track of each of the plurality of cutters is crisscrossed with the movement track of one of the plurality of crochet needles, each of the plurality of crochet needles comprises a butt portion, a hook portion, and a protruding shoulder portion between the butt portion and the hook portion, the protruding shoulder portion forms an eyelet, and each of the protruding shoulder portions of the plurality of crochet needles is configured to expand a yarn loop on one of the plurality of crochet needles to facilitate one of the plurality of cutters to cut the yarn loop at the eyelet to form a pile, wherein each of the plurality of crochet needles does not comprise a blade.

2. The circular knitting machine for knitting the pile fabric as claimed in claim 1, wherein each of the plurality of crochet needles is formed by assembling two needle plates with each other, each of the two needle plates comprises a bent section for forming the eyelet, each of the two needle plates comprises a boss on the bent section, and an inclined surface connected with the boss and extending toward the hook portion.

3. The circular knitting machine for knitting the pile fabric as claimed in claim 2, wherein each of the inclined surfaces comprises a turning convex point, and slopes of the inclined surface on two sides of the turning convex point are different.

4. The circular knitting machine for knitting the pile fabric as claimed in claim 3, wherein in each of the plurality of crochet needles, an opening of the hook portion is located on a side as same as the boss.

5. The circular knitting machine for knitting the pile fabric as claimed in claim 4, wherein the circular knitting machine comprises a plurality of crochet needle actuators provided for determining movement tracks of the plurality of crochet needles, a plurality of crochet needle cams provided for guiding the plurality of crochet needles, and a plurality of cutter cams provided for guiding the plurality of cutters.

6. The circular knitting machine for knitting the pile fabric as claimed in claim 1, wherein the circular knitting machine comprises a plurality of crochet needle actuators provided for determining movement tracks of the plurality of crochet needles, a plurality of crochet needle cams provided for guiding the plurality of crochet needles, and a plurality of cutter cams provided for guiding the plurality of cutters.

* * * * *